US006017403A

United States Patent [19]

Masumoto et al.

[11] Patent Number: 6,017,403

[45] Date of Patent: Jan. 25, 2000

[54] HIGH STRENGTH AND HIGH RIGIDITY ALUMINUM-BASED ALLOY

[75] Inventors: Tsuyoshi Masumoto, Sendai; Akihisa Inoue, 11-806 Kawauchi-jutaku, Kawauchi, Aoba-ku, Sendai-shi, Miyagi-ken; Yuma Horio, Hamamatsu, all of Japan

[73] Assignees: Yamaha Corporation; Isuyoshi Masumoto; Akihisa Inoue, all of Japan

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/601,949

[22] Filed: Feb. 15, 1996

Related U.S. Application Data

[63] Continuation-in-part of application No. 08/203,895, Mar. 1, 1994.

[30] Foreign Application Priority Data

Mar. 2, 1993 [JP] Japan ..... 5-041529

[51] Int. Cl.[7] ..... C22C 21/00

[52] U.S. Cl. ..... 148/549; 148/403; 148/437; 148/438; 420/550; 420/529; 420/538

[58] Field of Search ..... 420/550, 529, 420/538; 148/403, 437, 438

[56] References Cited

U.S. PATENT DOCUMENTS

| | | | |
|---|---|---|---|
| 5,294,242 | 3/1994 | Zurecki et al. | 75/345 |
| 5,419,789 | 5/1995 | Kita | 148/437 |
| 5,424,127 | 6/1995 | Dubois et al. | 428/373 |
| 5,472,920 | 12/1995 | Dubois et al. | 501/103 |
| 5,472,929 | 12/1995 | Dubois et al. | 501/103 |
| 5,593,515 | 1/1997 | Masumoto et al. | 148/415 |

FOREIGN PATENT DOCUMENTS

| | | |
|---|---|---|
| 62-37335 | 2/1987 | Japan . |
| 3257133 | 11/1991 | Japan . |
| 5311359 | 11/1993 | Japan . |

*Primary Examiner*—Patrick Ryan
*Assistant Examiner*—M. Alexandra Elve
*Attorney, Agent, or Firm*—Ostrolenk, Faber, Gerb & Soffen, LLP

[57] ABSTRACT

An aluminum-based alloy having the general formula $Al_xL_yM_z$ (wherein L is Mn or Cr; M is Ni, Co, and/or Cu; and x, y, and z, representing a composition ratio in atomic percentages, satisfy the relationships x+y+z=100, $75 \leqq x \leqq 95$, $2 \leqq y \leqq 15$, and $0.5 \leqq z \leqq 10$) having a metallographic structure comprising a quasi-crystalline phase possesses high strength and high rigidity. In order to enhance the ductility and toughness of the aluminum-based alloy, the atomic percentage of M may be further limited to $0.5 \leqq z \leqq 4$, and more preferably to $0.5 \leqq z \leqq 3$. The aluminum-based alloy is useful as a structural material for aircraft, vehicles and ships, and for engine parts; as material for sashes, roofing materials, and exterior materials for use in construction; or as materials for use in marine equipment, nuclear reactors, and the like.

16 Claims, 7 Drawing Sheets

HIGH STRENGTH AND HIGH RIGIDITY ALUMINUM-BASED ALLOY

CROSS REFERENCES TO RELATED APPLICATIONS

This application is a Continuation-in-Part of application Ser. No. 08/203,895 filed on Mar. 1, 1994, and entitled "High Strength and High Rigidity Aluminum-based Alloy".

BACKGROUND OF THE INVENTION

1. Field of the Invention

The present invention relates to an aluminum-based alloy for use in a wide range of applications such as in a structural material for aircraft, vehicles, and ships, and for engine parts. In addition, the present invention may be employed in sashes, roofing materials, and exterior materials for use in construction, or as material for use in marine equipment, nuclear reactors, and the like.

2. Description of Related Art

As prior art aluminum-based alloys, alloys incorporating various components such as Al—Cu, Al—Si, Al—Mg, Al—Cu—Si, Al—Cu—Mg, and Al—Zn—Mg are known. In all of the aforementioned, superior anti-corrosive properties are obtained at a light weight, and thus the aforementioned alloys are being widely used as structural material for machines in vehicles, ships, and aircraft, in addition to being employed in sashes, roofing materials, exterior materials for use in construction, structural material for use in LNG tanks, and the like.

However, the prior art aluminum-based alloys generally exhibit disadvantages such as a low hardness and poor heat resistance when compared to material incorporating Fe. In addition, although some materials have incorporated elements such as Cu, Mg, and Zn for increased hardness, disadvantages remain such as low anti-corrosive properties.

On the other hand, recently, experiments have been conducted in which a fine metallographic structure of aluminum-based alloys is obtained by means of performing quick-quench solidification from a liquid-melt state, resulting in the production of superior mechanical strength and anti-corrosive properties.

In Japanese Patent Application, First Publication No. 1-275732, an aluminum-based alloy comprising a composition $AlM_1X$ with a special composition ratio (wherein $M_1$ represents an element such as V, Cr, Mn, Fe, Co, Ni, Cu, Zr and the like, and X represents a rare earth element such as La, Ce, Sm, and Nd, or an element such as Y, Nb, Ta, Mm (misch metal) and the like), and having an amorphous or a combined amorphous/fine crystalline structure, is disclosed.

This aluminum-based alloy can be utilized as material with a high hardness, high strength, high electrical resistance, anti-abrasion properties, or as soldering material. In addition, the disclosed aluminum-based alloy has a superior heat resistance, and may undergo extruding or press processing by utilizing he superplastic phenomenon observed near crystallization temperatures.

However, the aforementioned aluminum-based alloy is disadvantageous in that high costs result from the incorporation of large amounts of expensive rare earth elements and/or metal elements with a high activity such as Y. Namely, in addition to the aforementioned use of expensive raw materials, problems also arise such as increased consumption and labor costs due to the large scale of the manufacturing facilities required to treat materials with high activities. Furthermore, this aluminum-based alloy having the aforementioned composition tends to display insufficient resistance to oxidation and corrosion.

U.S. Pat. No. 5,419,789 discloses an aluminum-based alloy having high strength and heat resistance which has a composition represented by the general formula $Al_{bal}Ni_aXbM_c$, wherein X is one or two elements selected from the group consisting of Fe and Co; M is at least one element selected from the group consisting of Cr, Mn, Mo, Ta, and W; a, b, and c are, in atomic percentages, $5 \leqq a \leqq 10$, $0.5 \leqq b \leqq 10$, and $0.1 \leqq c \leqq 5$. This aluminum-based alloy has a structure in which quasicrystals are homogeneously dispersed in a matrix composed of aluminum or a supersaturated solid solution of aluminum.

Although the aluminum-based alloy according to U.S. Pat. No. 5,419,789 may have high strength, high hardness, and high heat resistance, it does not have a sufficient ductility and toughness so as to be processible into a structural material.

SUMMARY OF THE INVENTION

It is an object of the present invention to provide an aluminum-based alloy, possessing superior strength, rigidity, and anti-corrosive properties, which comprises a composition in which rare earth elements or high activity elements such as Y are not incorporated, thereby effectively reducing the cost, as well as, the activity described in the aforementioned.

Furthermore, it is another object of the present invention to provide the above aluminum-based alloy with a desirable ductility and toughness so as to be processible into a structural material.

In order to solve the aforementioned problems, the present invention provides a high strength and high rigidity aluminum-based alloy consisting essentially of a composition represented by the general formula $Al_xL_yM_z$ (wherein L is a metal element selected from Mn and Cr; M is at least one metal element selected from Ni, Co, and Cu; and x, y, and z, which represent a composition ratio in atomic percentages, satisfy the relationships $x+y+z=100$, $75 \leqq x \leqq 95$, $2 \leqq y \leqq 15$, and $0.5 \leqq z \leqq 10$) having a metallographic structure comprising a quasi-crystalline phase.

Furthermore, in order to enhance the ductility and toughness of the aluminum-based alloy according to the present invention, the atomic percentage of the metal element M (Ni, Co, or Cu) may be further limited to the range of $0.5 \leqq z \leqq 4$, and more preferably $0.5 \leqq z \leqq 3$.

In addition, the aforementioned high strength and high rigidity aluminum-based alloy according to the present invention may substitute Ti or Zr in place of element M, in an amount corresponding to one-half or less of the atomic percentage of element M.

According to the present invention, by adding a predetermined amount of Mn or Cr to Al, the ability of the alloy to form a quasi-crystalline phase is improved, and the strength, hardness, and toughness of the alloy is also improved. Moreover, by adding a predetermined amount of Ni, Co, and/or Cu, the effects of quick-quenching are enhanced, the thermal stability of the overall metallographic structure is improved, and the strength and hardness of the resulting alloy are also increased.

In addition, the limitation of the atomic percentage of the metal element M (Ni, Co, or Cu) to the range of $0.5 \leqq z \leqq 4$ prevents precipitation of an undesirable intermetallic compound (such as $Al_3Ni$, $Al_9Co_2$, $Al_2Cu$) which substantially reduces the ductility and toughness of the aluminum-based alloy. Accordingly, by limiting the atomic percentage of the metal element M to the range of $0.5 \leqq z \leqq 4$, and more preferably, to the range of $0.5 \leqq z \leqq 3$, the ductility and toughness of the aluminum-based alloy can be improved. Thus, such an aluminum-based alloy exhibits an enhanced impact strength, and can be readily processed into a desired material such as a structural material.

Furthermore, by adding predetermined amounts of Ti or Zr, the effects of quick-quenching are enhanced, the fine grains are precipitated, and the strength is improved.

The aluminum-based alloy according to the present invention is useful as materials with a high hardness, strength, and rigidity. Furthermore, this alloy also stands up well to bending, and thus possesses superior properties such as the ability to be mechanically processed.

Accordingly, the aluminum-based alloys according to the present invention can be used in a wide range of applications such as in the structural material for aircraft, vehicles, and ships, as well as for engine parts. In addition, the aluminum-based alloys of the present invention may be employed in sashes, roofing materials, and exterior materials for use in construction, or as materials for use in marine equipment, nuclear reactors, and the like.

DETAILED DESCRIPTION OF THE PREFERRED EMBODIMENTS

Figure 1:
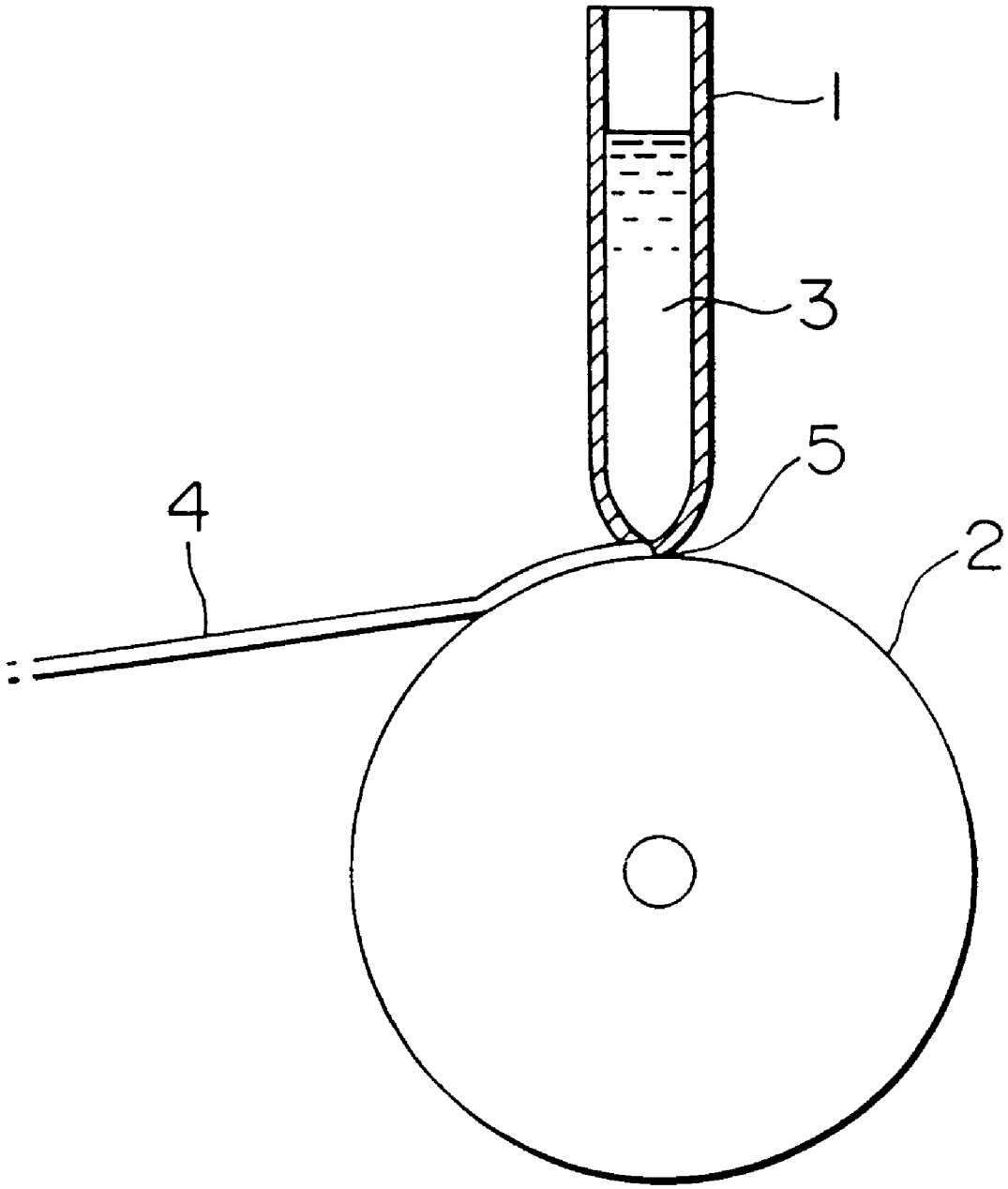
FIG. 1 shows a construction of an example of a single roll apparatus used at the time of manufacturing a tape of an alloy of the present invention following quick-quench solidification.

The first preferred embodiment of the present invention provides a high strength and high rigidity aluminum-based alloy consisting essentially of a composition represented by the general formula $Al_xL_yM_z$ (wherein L is a metal element selected from Mn and Cr; M is at least one metal element selected from Ni, Co, and Cu; and x, y, and z, which represent a composition ratio in atomic percentages, satisfy the relationships $x+y+z=100$, $75 \leqq x \leqq 95$, $2 \leqq y \leqq 15$, and $0.5 \leqq z \leqq 10$), comprising a quasi-crystalline phase in the alloy. It is more preferable that the atomic percentage of the metal element M be further limited to the range of $0.5 \leqq z \leqq 4$. It is even more preferable that the atomic percentage of the metal element M be limited to the range of $0.5 \leqq z \leqq 3$.

The second preferred embodiment of the present invention is a high strength and high rigidity aluminum-based alloy, substituting Ti or Zr in place of element M in the first preferred embodiment, in an amount corresponding to one-half or less of the atomic percentage of element M.

In the following, the reasons for limiting the composition ratio of each component in the alloy according to the present invention are explained.

The atomic percentage of Al is in the range of $75 \leqq Al \leqq 95$. An atomic percentage for Al of less than 75% results in embrittlement of the alloy. On the other hand, an atomic percentage for Al exceeding 95% results in reduction of the strength and hardness of the alloy.

The amount of Cr or Mn in atomic percentage is at least 2%, and does not exceed 15%. If this amount is less than 2%, a quasi-crystalline phase cannot be obtained, and the strength and hardness are not improved. On the other hand, if this amount exceeds 15%, embrittlement of the alloy occurs, and the toughness and rigidity of the alloy are reduced.

The amount of Ni, Co, or Cu in atomic percentage is at least 0.5% and does not exceed 10%. If this amount is less than 0.5%, the strength and hardness of the alloy are not improved. If the amount exceeding 10% is used in combination with a quasi-crystal forming two-component alloy of an Al—Cr or Al—Mn type, embrittlement and reduction of toughness occur.

In addition, when the amount of Ni, Co, or Cu is not more than 4% (more preferably, not more than 3%), precipitation of an undesirable intermetallic compound (such as $Al_3Ni$, $Al_9CO_2$, $Al_2Cu$), which substantially reduces the ductility and toughness of the aluminum-based alloy, is prevented. Thus, an aluminum alloy which has a desirable impact strength and which can be readily processed into a desired material such as a structural material can be obtained.

The amount of Ti or zr is restricted in the range not exceeding one-half of the amount of element M. However, when this amount in atomic percentage is less than 0.5%, the quick-quenching effect is not improved, and, in the case when a crystalline state is incorporated into the metallographic structure of the alloy, the crystalline grains are not finely crystallized. On the other hand, when this amount exceeds 5%, the strength, hardness, and toughness are reduced.

The aforementioned aluminum-based alloys can be manufactured by quick-quench solidification of the alloy liquid-melts having the aforementioned compositions using a liquid quick-quenching method. This liquid quick-quenching method essentially entails rapid cooling of the melted alloy. For example, single roll, double roll, and submerged rotational spin methods have proved to be particularly effective. In these aforementioned methods, a cooling rate of $10^4$ to $10^6$ K/sec is easily obtainable.

In order to manufacture a thin tape using the aforementioned single or double roll methods, the liquid-melt is first poured into a storage vessel such as a silica tube, and is then discharged, via a nozzle aperture at the tip of the silica tube, towards a copper roll of diameter 30 to 300 mm, which is rotating at a fixed velocity in the range of 300 to 1000 rpm. In this manner, various types of thin tapes of thickness 5–500 $\mu$m and width 1–300 mm can be easily obtained.

On the other hand, fine wire-thin material can be easily obtained through the submerged rotational spin method by discharging the liquid-melt via the nozzle aperture, into a refrigerant solution layer of depth 1 to 10 cm, maintained by means of centrifugal force inside an air drum rotating at 50 to 500 rpm, under argon gas back pressure. In this case, the angle between the liquid-melt discharged from the nozzle, and the refrigerant surface is preferably 60 to 90 degrees, and the relative velocity ratio of the liquid-melt and the refrigerant surface is preferably 0.7 to 0.9.

In addition, thin layers of aluminum-based alloy of the aforementioned compositions can also be obtained without using the above methods, by employing layer formation processes such as the sputtering method. In addition, aluminum alloy powder of the aforementioned compositions can be obtained by quick-quenching the liquid-melt using various atomizer and spray methods such as a high pressure gas spray method.

In the following, examples of metallographic-structural states of the aluminum-based alloy obtained using the aforementioned methods are listed:

(1) Multiphase structure incorporating a quasi-crystalline phase and a pure-aluminum phase;

(2) Multiphase structure incorporating a quasi-crystalline phase and a metal solid solution having an aluminum matrix;

(3) Multiphase structure incorporating a quasi-crystalline phase and a stable or metastable intermetallic compound phase; and (4) Multiphase structure incorporating a quasi-crystalline phase, an amorphous phase, and a metal solid solution having an aluminum matrix.

A widely-recognized definition of "quasi-crystalline" is given for a structure satisfying the following three conditions with respect to the reciprocal lattice or diffraction pattern:

(A) the diffraction pattern consists of a set of δ-functions (or points);

(B) the number of fundamental unit vectors describing the distribution of the reciprocal lattice points (diffraction particles) must be greater than the number of dimensions (i.e., equal to or greater than four for an actual quasi-crystal); and (C) the structure has a rotation symmetry which is not permitted for a crystal. (It should be noted that a crystal has only one-, two-, three-, four-, or six-fold rotation symmetry.)

Condition (A) may be satisfied by a crystal.

In the case of a crystal, when three short, independent diffraction vectors a*, b*, and c* are chosen as the fundamental vectors as in Condition (B), all diffraction points can be formulated as a linear combination of the three vectors, namely, the formula 1a*+mb*+nc*. However, since more than three fundamental unit vectors are necessary for an incommensurate crystal, a material cannot be identified as a quasi-crystal by merely satisfying Conditions (A) and (B). Thus, a quasi-crystal must also meet Condition (C). (When a lattice is modulated by a period a' which differs from the natural period a, if the value a'/a is an irrational number, such a crystal is called an "incommensurate crystal". Such a modulation occurs when re-distribution of electrons, such as charge density wave, affects the lattice.)

The above definition of quasi-crystal relates to reciprocal lattices. Therefore, examination of diffraction patterns in detail allows experimental judgment as to whether or not a material is a quasi-crystal.

Specifically, quasi-crystals having a five-fold rotation symmetry are known. As quasi-crystalline phases defined in the above, regular icosahedral phase, regular decagonal phase, regular dodecagonal phase, and regular octagonal phase have been found.

A quasi-crystal was first discovered by Shechtmann, et al., of Israel in 1984. This quasi-crystal was of the regular icosahedral phase (D. Shechtmann, I. A. Blech, D. Gratias, and J. W. Cahn; Phys. Rev. Lett., 53 (1984), 195).

The fine crystalline phase of the present invention represents a crystalline phase in which the crystal particles have an average maximum diameter of 1 μm.

By regulating the cooling rate of the alloy liquid-melt, any of the metallographic-structural states described in (1) to (4) above can be obtained.

The properties of the alloys possessing the aforementioned metallographic-structural states are described in the following.

An alloy of the multiphase structural state described in (1) and (2) above has a high strength and an excellent bending ductility.

An alloy of the multiphase structural state described in (3) above has a higher strength and lower ductility than the alloys of the multiphase structural state described in (1) and (2). However, the lower ductility does not hinder its high strength.

An alloy of the multiphase structural state described in (4) has a high strength, high toughness and a high ductility.

Each of the aforementioned metallographic-structural states can be easily determined by a normal X-ray diffraction method or by observation using a transmission electron microscope. In the case when a quasi-crystal exists, a dull peak, which is characteristic of a quasi-crystalline phase, is exhibited.

By regulating the cooling rate of the alloy liquid-melt, any of the multiphase structural states described in (1) to (3) above can be obtained.

By quick-quenching the alloy liquid-melt of the Al-rich composition (e.g., composition with Al ≧92 atomic %), any of the metallographic-structural states described in (4) can be obtained.

The aluminum-based alloy of the present invention displays superplasticity at temperatures near the crystallization temperature (crystallization temperature ±100° C.), as well as, at the high temperatures within the fine crystalline stable temperature range, and thus processes such as extruding, pressing, and hot forging can easily be performed. Consequently, aluminum-based alloys of the above-mentioned compositions obtained in the aforementioned thin tape, wire, plate, and/or powder states can be easily formed into bulk materials by means of extruding, pressing and hot forging processes at the aforementioned temperatures. Furthermore, the aluminum-based alloys of the aforementioned compositions possess a high ductility, thus bending of 180° is also possible.

Additionally, the aforementioned aluminum-based alloys having multiphase structure composed of a pure-aluminum phase, a quasi-crystalline phase, a metal solid solution, and/or an amorphous phase, and the like, do not display structural or chemical non-uniformity of crystal grain boundary, segregation and the like, as seen in crystalline alloys. These alloys cause passivation due to formation of an aluminum oxide layer, and thus display a high resistance to corrosion. Furthermore, disadvantages exist when incorporating rare earth elements: due to the activity of these rare earth elements, non-uniformity occurs easily in the passive layer on the alloy surface resulting in the progress of corrosion from this portion towards the interior. However, since the alloys of the aforementioned compositions do not incorporate rare earth elements, these aforementioned problems are effectively circumvented.-

In regard to the aluminum-based alloy of the aforementioned compositions, the manufacturing of bulk-shaped (mass) material will now be explained.

When heating the aluminum-based alloy according to the present invention, precipitation and crystallization of the fine crystalline phase is accompanied by precipitation of the aluminum matrix (α-phase), and when further heating beyond this temperature, the intermetallic compound also precipitates. Utilizing this property, bulk material possessing a high strength and ductility can be obtained.

Concretely, the tape alloy manufactured by means of the aforementioned quick-quenching process is pulverized in a ball mill, and then powder pressed in a vacuum hot press under vacuum (e.g., $10^{-3}$ Torr) at a temperature slightly below the crystallization temperature (e.g., approximately 470 K), thereby forming a billet for use in extruding with a diameter and length of several centimeters. This billet is set inside a container of an extruder, and is maintained at a temperature slightly greater than the crystallization temperature for several tens of minutes. Extruded materials can then be obtained In desired shapes such as round bars, etc., by extruding.

EXAMPLES

Example 1

A molten alloy having a predetermined composition was manufactured using a high frequency melting furnace. Then, as shown in FIG. 1, this melt was poured into a silica tube 1 with a small aperture 5 (aperture diameter: 0.2 to 0.5 mm) at the tip, and then heated to melt, after which the aforementioned silica tube 1 was positioned directly above copper roll 2. This roll 2 was then rotated at a high speed of 4000 rpm, and argon gas pressure (0.7 kg/cm$^3$) was applied to silica tube 1. Quick-quench solidification was subsequently performed by quick-quenching the liquid-melt by means of discharging the liquid-melt from small aperture 5 of silica tube 1 onto the surface of roll 2 and quick-quenching to yield an alloy tape 4.

Under these manufacturing conditions, the numerous alloy tape samples (width: 1 mm, thickness: 20 μm) of the compositions (atomic percentages) shown in Tables 1 and 2 were formed. Each sample was examined by both X-ray diffraction and TEM (transmission electron microscope), and thus, the results shown in Tables 1 and 2 were obtained.

TABLE 1

| Sample No. | Alloy composition (Subscript numerals represent atomic percentage) | $\sigma_f$ (MPa) | Hv (DPN) | Metallographic structural state | Bending test | |
|---|---|---|---|---|---|---|
| 1 | $Al_{98}Mn_1Ni_1$ | 380 | 98 | fcc-Al | Duc | Comparative Example |
| 2 | $Al_{95}Mn_4Ni_1$ | 980 | 280 | fcc-Al + Q | Duc | Example |
| 3 | $Al_{90}Mn_7Ni_3$ | 1210 | 380 | fcc-Al + Q | Duc | Example |
| 4 | $Al_{80}Mn_{10}Ni_{10}$ | 1270 | 375 | fcc-Al + Q | Duc | Example |
| 5 | $Al_{75}Mn_{15}Ni_{10}$ | 1105 | 360 | fcc-Al + Amo + Q | Duc | Example |
| 6 | $Al_{70}Mn_{15}Ni_{15}$ | — | 550 | Q | Bri | Comparative Example |
| 7 | $Al_{95}Cr_1Co_4$ | 270 | 90 | fcc-Al | Duc | Comparative Example |
| 8 | $Al_{95}Cr_2Co_3$ | 980 | 240 | fcc-Al + Q | Duc | Example |
| 9 | $Al_{93}Cr_5Co_2$ | 1240 | 310 | fcc-Al + Q | Duc | Example |
| 10 | $Al_{85}Cr_{10}Co_5$ | 1210 | 375 | fcc-Al + Q | Duc | Example |
| 11 | $Al_{83}Cr_{15}Co_2$ | 1070 | 310 | fcc-Al + Q | Duc | Example |
| 12 | $Al_{75}Cr_{20}Co_5$ | — | 530 | Q + Com | Bri | Comparative Example |
| 13 | $Al_{93.7}Mn_6Cu_{0.3}$ | 375 | 103 | fcc-Al | Duc | Comparative Example |
| 14 | $Al_{94}Cr_{5.5}Cu_{0.5}$ | 1230 | 310 | fcc-Al + Q | Duc | Example |
| 15 | $Al_{93}Mn_6Cu_1$ | 1112 | 333 | fcc-Al + Q | Duc | Example |
| 16 | $Al_{90}Cr_7Cu_3$ | 1150 | 320 | fcc-Al + Q | Duc | Example |
| 17 | $Al_{88}Mn_7Cu_5$ | 1202 | 322 | fcc-Al + Q | Duc | Example |
| 18 | $Al_{87}Cr_6Cu_7$ | 1230 | 350 | fcc-Al + Q | Duc | Example |
| 19 | $Al_{84}Mn_6Cu_{10}$ | 1195 | 354 | fcc-Al + Q | Duc | Example |
| 20 | $Al_{82}Cr_6Cu_{12}$ | — | 490 | Q + Com | Bri | Comparative Example |

TABLE 2

| Sample No. | Alloy composition (Subscript numerals represent atomic percentage) | $\sigma_f$ (MPa) | Hv (DPN) | Metallographic structural state | Bending test | |
|---|---|---|---|---|---|---|
| 21 | $Al_{91}Mn_7Co_2$ | 1170 | 343 | fcc-Al + Q | Duc | Example |
| 22 | $Al_{91}Cr_6Ni_3$ | 1210 | 320 | fcc-Al + Q | Duc | Example |
| 23 | $Al_{91}Mn_7Ni_1Co_1$ | 1160 | 305 | fcc-Al + Q | Duc | Example |

TABLE 2-continued

| Sample No. | Alloy composition (Subscript numerals represent atomic percentage) | $\sigma_f$ (MPa) | Hv (DPN) | Metallographic structural state | Bending test | |
|---|---|---|---|---|---|---|
| 24 | $Al_{90}Mn_7Ni_1Cu_2$ | 1190 | 340 | fcc-Al + Q | Duc | Example |
| 25 | $Al_{88}Mn_6Co_4Cu_2$ | 1270 | 361 | fcc-Al + Amo + Q | Duc | Example |
| 26 | $Al_{87}Mn_7Ni_1Co_4Cu_1$ | 1260 | 359 | fcc-Al + Q | Duc | Example |
| 27 | $Al_{93}Cr_5Ni_1Co_1$ | 1010 | 280 | fcc-Al + Q | Duc | Example |
| 28 | $Al_{88}Cr_7Ni_3Cu_2$ | 1205 | 370 | fcc-Al + Q | Duc | Example |
| 29 | $Al_{87}Cr_{10}Co_2Cu_1$ | 1210 | 381 | fcc-Al + Q | Duc | Example |
| 30 | $Al_{89}Cr_8Ni_1Co_1Cu_1$ | 1185 | 365 | fcc-Al + Q | Duc | Example |
| 31 | $Al_{77}Mn_7Co_9Ti_7$ | 1310 | 380 | fcc-Al + Q | Duc | Example |
| 32 | $Al_{80}Cr_5Ni_2Zr_5$ | 1290 | 360 | fcc-Al + Amo + Q | Duc | Example |
| 33 | $Al_{83}Mn_6Cu_8Ti_3$ | 1230 | 362 | fcc-Al + Amo + Q | Duc | Example |
| 34 | $Al_{88}Cr_5Ni_2Co_4Zr_1$ | 1160 | 342 | fcc-Al + Q | Duc | Example |
| 35 | $Al_{87.5}Mn_6Ni_4Cu_2Ti_{0.5}$ | 1130 | 346 | fcc-Al + Q | Duc | Example |
| 36 | $Al_{91}Cr_5Co_2Cu_{1.7}Zr_{0.3}$ | 1040 | 305 | fcc-Al + Q | Duc | Example |

These results, shown in the metallographic-structural state column of Tables 1 and 2, confirmed that multiphase structures (fcc-Al+Q) incorporating a fine Al-crystalline phase having fcc structure and a fine regular-icosahedral quasi-crystal, or multiphase structures (fcc-Al+Amo+Q) incorporating a fine Al-crystalline phase, a fine regular-icosahedral quasi-crystal, and an amorphous phase, were obtained.

Subsequently, the hardness (Hv) and tensile rupture strength (σf: MPa) of each alloy tape sample were measured. These results are also shown in Tables 1 and 2. The hardness is expressed in the value measured according to the minute Vickers hardness scale (DPN: Diamond Pyramid Number).

Additionally, a 180° contact bending test was conducted by bending each sample 180° and contacting the ends, thereby forming a U-shape. The results of these tests are also shown in Tables 1 and 2: those samples which displayed ductility and did not rupture are designated Duc (ductile), while those which ruptured are designated Bri (brittle).

It is clear from the results shown in Tables 1 and 2 that an aluminum-based alloy possessing a high bearing force and hardness, which endured bending and could undergo processing, was obtainable when the alloy comprising at least one of Ni, Co, and Cu, as element M, in addition to an Al—Mn or Al—Cr two-component alloy has the atomic percentages satisfied the relationships $75 \leqq Al \leqq 95$, $2 \leqq Cr \leqq 15$, and $0.5 \leqq M \leqq 10$; or $75 \leqq Al \leqq 95$, $2 \leqq Mn \leqq 15$, and $0.5 \leqq M \leqq 10$.

In contrast to normal aluminum-based alloys which possess an Hv of approximately 50 to 100 DPN, the samples according to the present invention, shown in Tables 1 and 2, display an extremely high hardness from 240 to 381 DPN.

In addition, in regards to the tensile rupture strength ($\sigma_f$), normal age hardened type aluminum-based alloys (Al—Si—Fe type) possess values from 200 to 600 MPa; however, the samples according to the present invention have clearly superior values in the range from 980 to 1310 MPa.

Furthermore, when considering that the tensile strengths of aluminum-based alloys of the AA6000 series (alloy name according to the Aluminum Association (U.S.A.)) and AA7000 series which lie in the range from 250 to 300 MPa, Fe-type structural steel sheets which possess a value of approximately 400 MPa, and high tensile strength steel sheets of Fe-type which range from 800 to 980 MPa, it is clear that the aluminum-based alloys according to the present invention display superior values.

Figure 2:
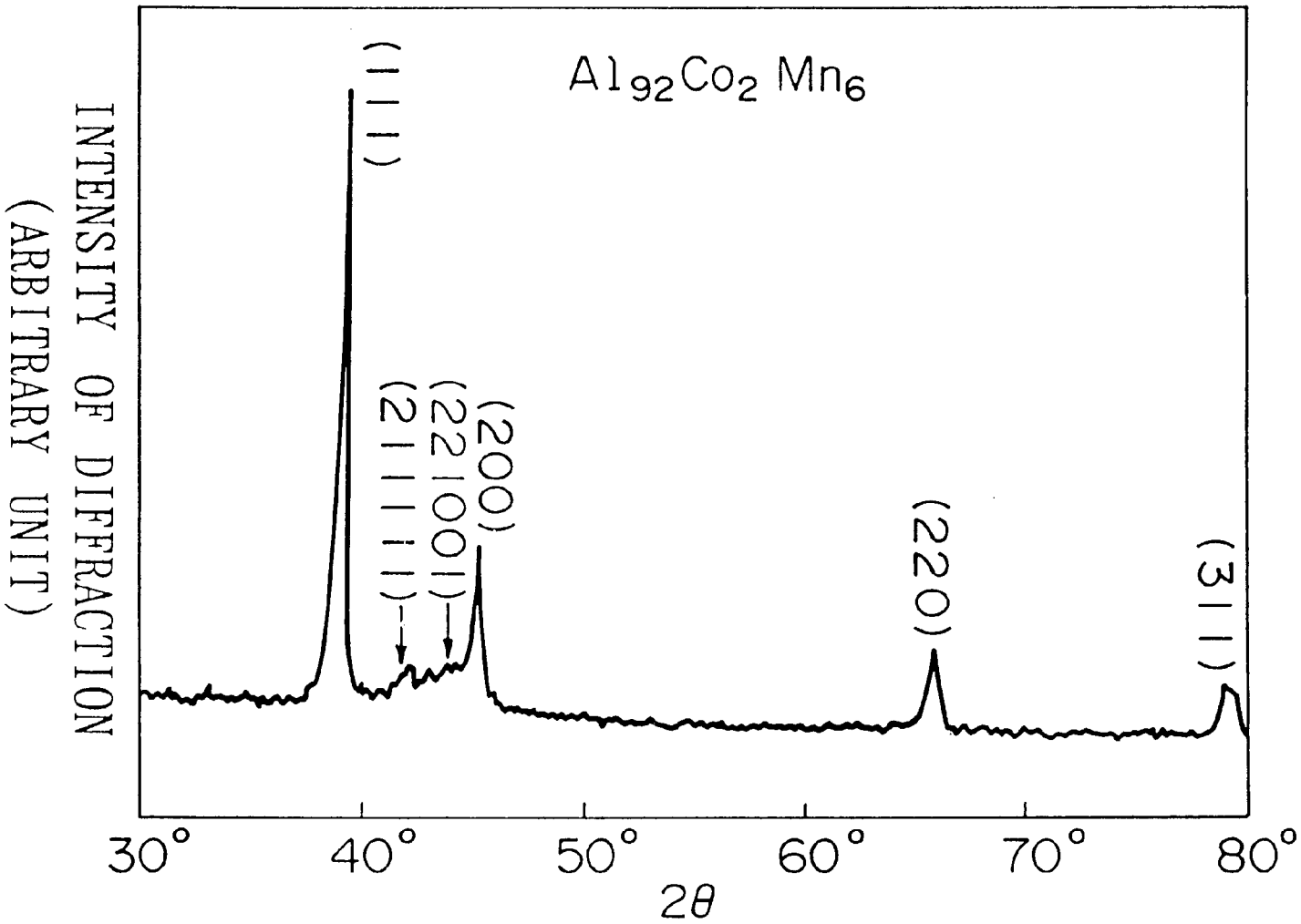
FIG. 2 shows the analysis result of the X-ray diffraction of an alloy having the composition of $Al_{92}Co_2Mn_6$.
Figure 3:
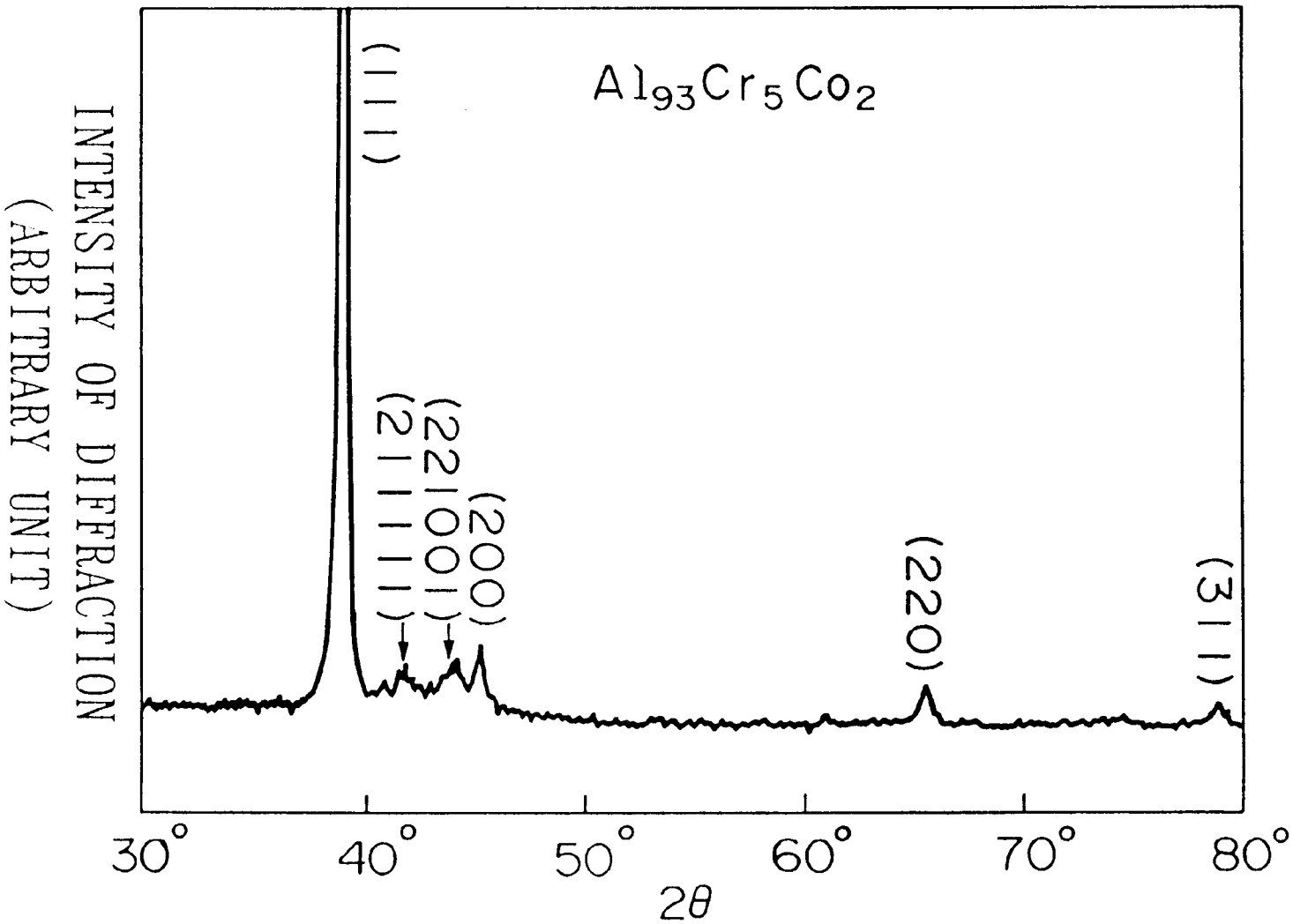
FIG. 3 shows the analysis result of the X-ray diffraction of an alloy having the composition of $Al_{93}Cr_5CO_2$.
Figure 4:
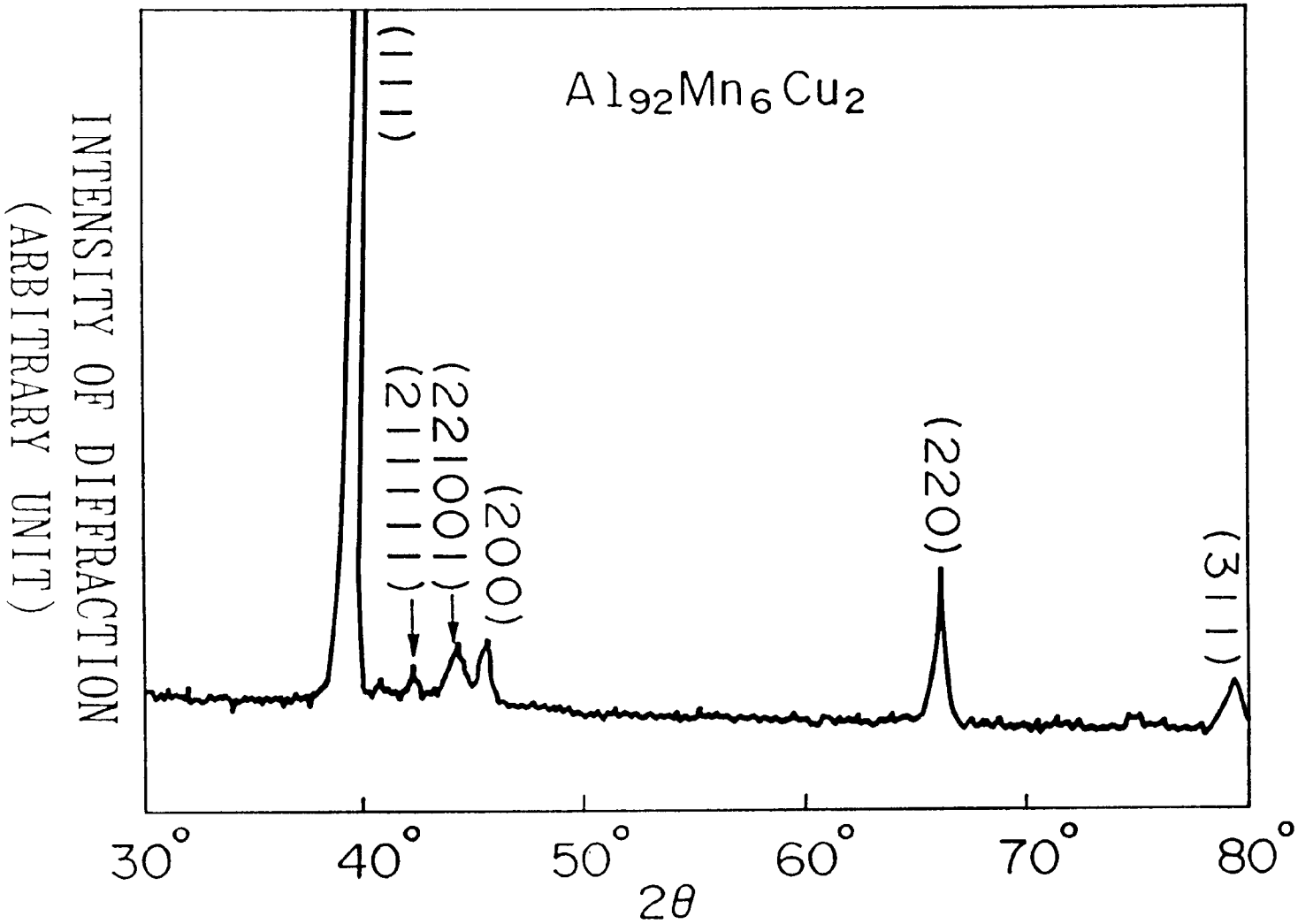
FIG. 4 shows the analysis result of the X-ray diffraction of an alloy having the composition of $Al_{92}Mn_6Cu_2$.

FIG. 2 shows an X-ray diffraction pattern possessed by an alloy sample having the composition of $Al_{92}Co_2Mn_6$. FIG. 3 shows an X-ray diffraction pattern possessed by an alloy sample having the composition of $Al_{93}Cr_5Co_2$. FIG. 4 shows an X-ray diffraction pattern possessed by an alloy sample having the composition of $Al_{92}Mn_6Cu_2$. According to these patterns, each of these three alloy samples has a multiphase structure comprising a fine Al-crystalline phase having an fcc structure and a fine regular-icosahedral quasi-crystalline phase. In these patterns, peaks expressed as (111), (200), (220), and (311) are crystalline peaks of Al having an fcc structure, while peaks expressed as (211111) and (221001) are dull peaks of regular-icosahedral quasi crystals.

Figure 5:
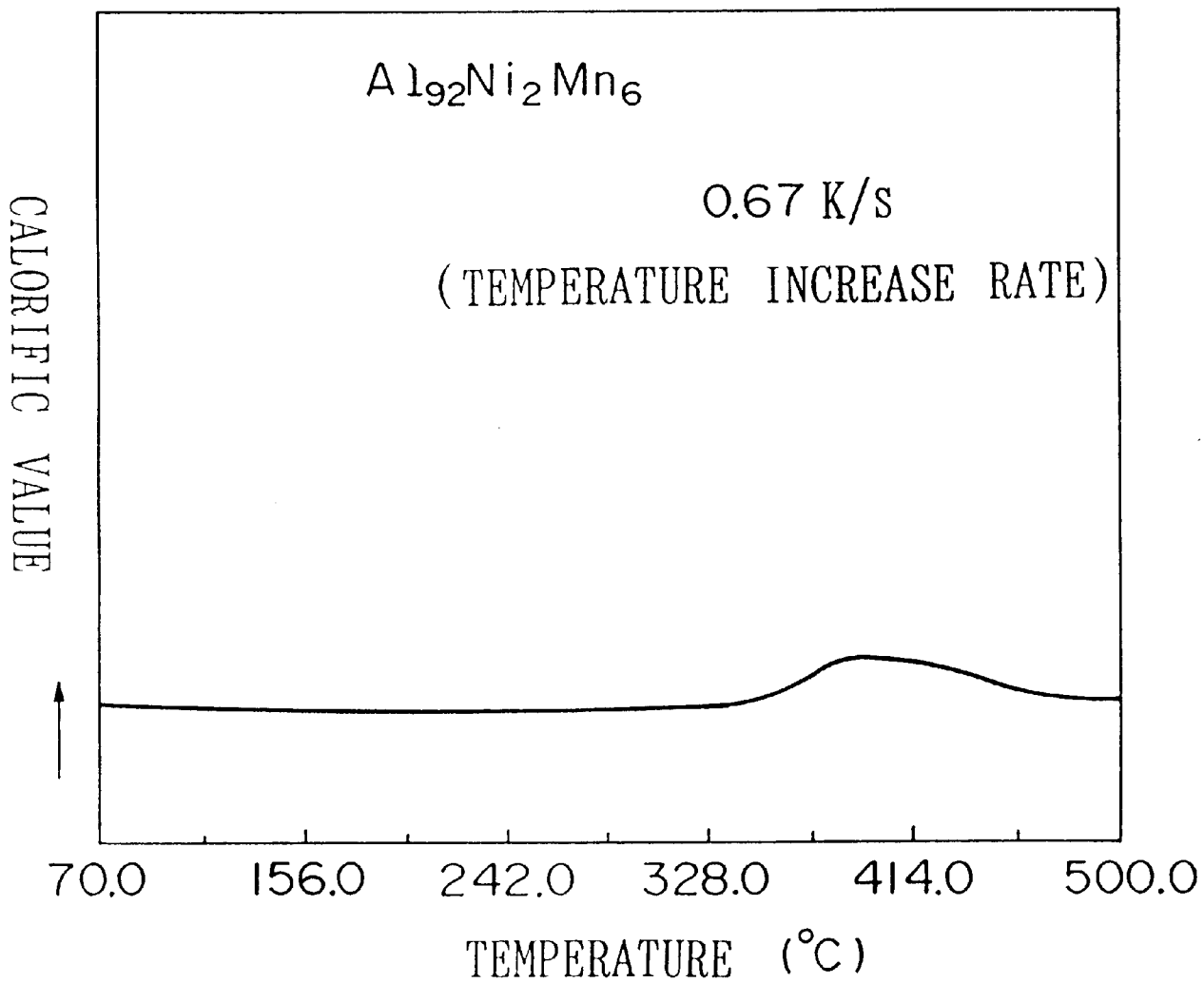
FIG. 5 shows the thermal properties of an alloy having the composition of $Al_{92}Ni_2Mn_6$.

FIG. 5 shows the DSC (Differential Scanning Calorimetry) curve in the case when an alloy having the composition of $Al_{92}Ni_2Mn_6$ is heated at rate of 0.67 K/s. In this figure, a dull exothermal peak, which is obtained when a quasi-crystalline phase is changed to a stable crystalline phase, is seen in the high temperature region.

Example 2

In order to evaluate the relationship between the atomic percentage of the metal element M (Ni, Co, or Cu) and the toughness of aluminum-based alloy, plastic elongation percentages in tension tests of aluminum-based alloys were measured. Each sample was prepared in the shape of a tape by quick-quenching in accordance with a single roll method, in a manner similar to that of Example 1. The elongation percentages measured in the tension tests are shown in Table 3.

From the results in Table 3, it is confirmed that when the atomic percentage of the metal element M (Ni, Co, or Cu) is 5% or higher, plastic elongation was scarcely observed.

It should be noted that a brittle (Bri) sample in the bending zest of Example 1 has the elongation percentage of 0%, with which a tension test cannot be conducted, whereas a ductile (Duc) sample has the elongation percentage of more than 0%. Even when a sample is considered to be ductile in the bending test, if the sample has the elongation percentage of less than 1%, it is fragile and may be damaged by impact.

In Table 3, samples having the atomic percentage of the metal element M (Ni, Co, or Cu) of 5% or higher exhibited elongation percentages of less than 1%. Thus, these samples are fragile and may be damaged by impact. In contrast, samples having the atomic percentage of the metal element M of 4% or lower exhibited high elongation percentages, and thus possessed high impact strength.

TABLE 3

Plastic Elongation of Quick-Quenched Tape Samples

| Sample No. | Alloy composition (Subscript numerals represent atomic percentage) | Plastic elongation (%) |
|---|---|---|
| 37 | $Al_{93}Mn_5Ni_2$ | 6.2 |
| 38 | $Al_{92}Mn_5Ni_3$ | 5.1 |
| 39 | $Al_{91}Mn_5Ni_4$ | 5.0 |
| 40 | $Al_{90}Mn_5Ni_5$ | 0.9 |
| 41 | $Al_{87}Mn_5Ni_8$ | 0.8 |
| 42 | $Al_{92}Mn_6Ni_2$ | 6.2 |
| 43 | $Al_{89}Mn_6Ni_5$ | 0.7 |
| 44 | $Al_{92}Mn_6Co_2$ | 7.2 |
| 45 | $Al_{90}Mn_6Co_4$ | 4.8 |
| 46 | $Al_{89}Mn_6Co_5$ | 0.8 |
| 47 | $Al_{87}Mn_6Co_7$ | 0.8 |
| 48 | $Al_{91}Mn_6Cu_3$ | 5.2 |
| 49 | $Al_{90}Mn_6Cu_4$ | 4.9 |
| 50 | $Al_{89}Mn_6Cu_5$ | 0.7 |
| 51 | $Al_{87}Mn_6Cu_7$ | 0.3 |
| 52 | $Al_{90}Mn_6Ni_2Co_2$ | 4.8 |
| 53 | $Al_{91}Mn_6Ni_1Cu_2$ | 6.5 |
| 54 | $Al_{90}Mn_6Co_2Cu_2$ | 6.2 |
| 55 | $Al_{89}Mn_6Ni_2Co_3$ | 0.8 |
| 56 | $Al_{93}Cr_5Ni_2$ | 5.9 |
| 57 | $Al_{92}Cr_5Ni_3$ | 6.0 |
| 58 | $Al_{91}Cr_5Ni_4$ | 5.4 |
| 59 | $Al_{90}Cr_5Ni_5$ | 0.7 |
| 60 | $Al_{87}Cr_5Ni_8$ | 0.6 |
| 61 | $Al_{92}Cr_6Ni_2$ | 6.4 |
| 62 | $Al_{89}Cr_6Ni_5$ | 0.5 |
| 63 | $Al_{92}Cr_6Co_2$ | 5.5 |
| 64 | $Al_{90}Cr_6Co_4$ | 5.8 |
| 65 | $Al_{89}Cr_6Co_5$ | 0.6 |
| 66 | $Al_{87}Cr_6Co_7$ | 0.7 |
| 67 | $Al_{91}Cr_6Cu_3$ | 6.2 |
| 68 | $Al_{90}Cr_6Cu_4$ | 6.8 |
| 69 | $Al_{89}Cr_6Cu_5$ | 0.4 |
| 70 | $Al_{87}Cr_6Cu_7$ | 0.5 |
| 71 | $Al_{90}Cr_6Ni_2Co_2$ | 5.0 |
| 72 | $Al_{91}Cr_6Ni_1Cu_2$ | 6.2 |
| 73 | $Al_{90}Cr_6Co_2Cu_2$ | 5.8 |
| 74 | $Al_{89}Cr_6Co_3Cu_2$ | 0.5 |

Example 3

The aluminum-based alloy according to the present invention may be practically applied to a bulk material. Accordingly, the properties of aluminum-based alloys in bulk form were evaluated. Each sample was prepared as follows.

First, a rapidly solidified powder was formed in accordance with high pressure gas atomization. The powder having a particle diameter of not more than 25 $\mu$m was filled in a copper container so as to be formed into a billet. The billet was then formed into a bulk sample using a 100-ton hot extruding press machine at a cross section reduction ratio of 80%, a extrusion speed of 5 mm/sec, and a extrusion temperature of 573 K.

The Charpy impact test was carried out with each bulk sample to measure the Charpy impact value. The results are shown in Table 4 and FIGS. 6 and 7. Higher Charpy impact values indicates higher toughness of the sample.

Figure 6:
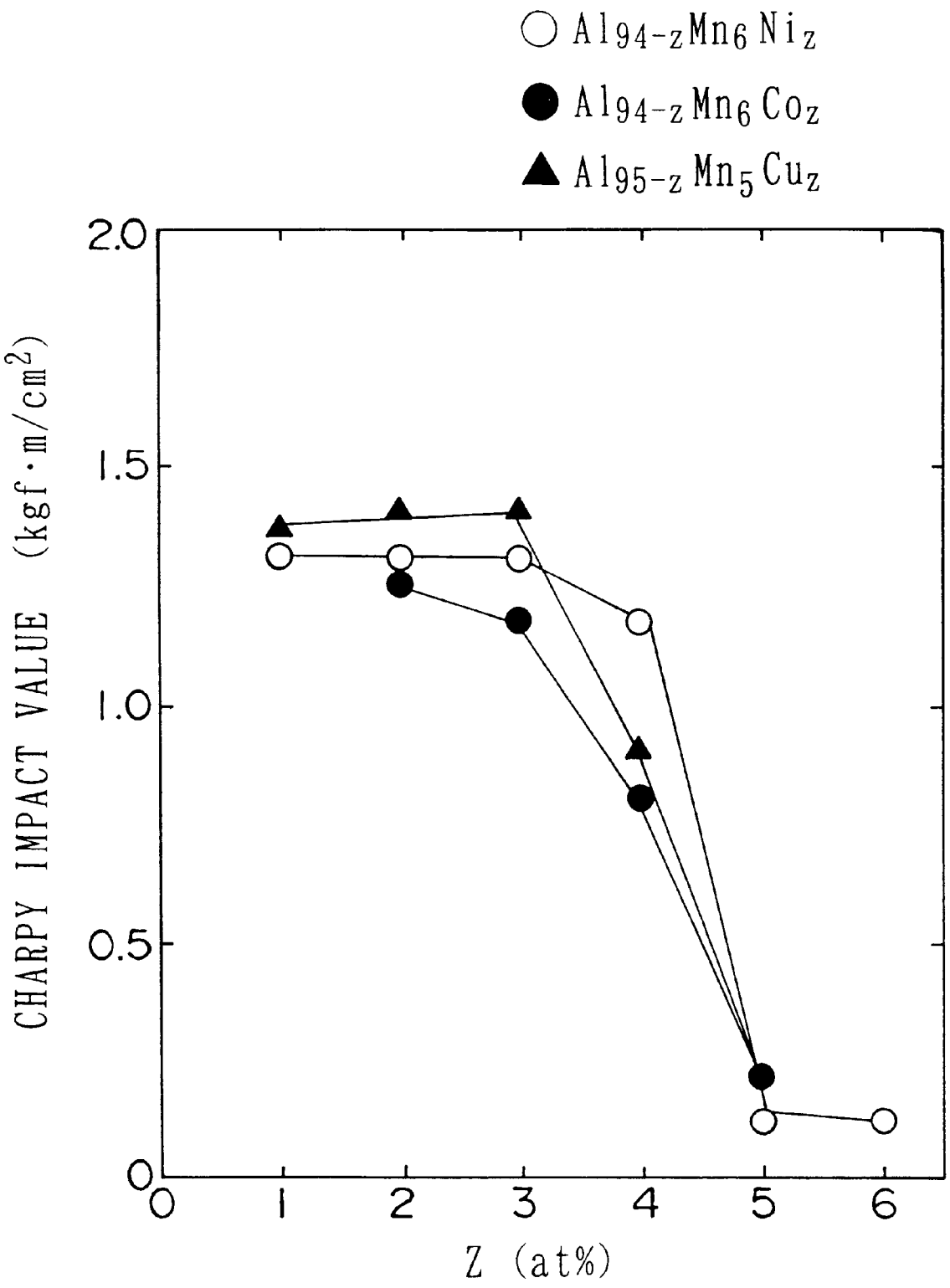
FIG. 6 is a graph showing the relationship between the atomic percentage of M (Ni, Co, or Cu) in the aluminum-based alloy $Al_xMn_yM_z$ and the Charpy impact value of the alloy.
Figure 7:
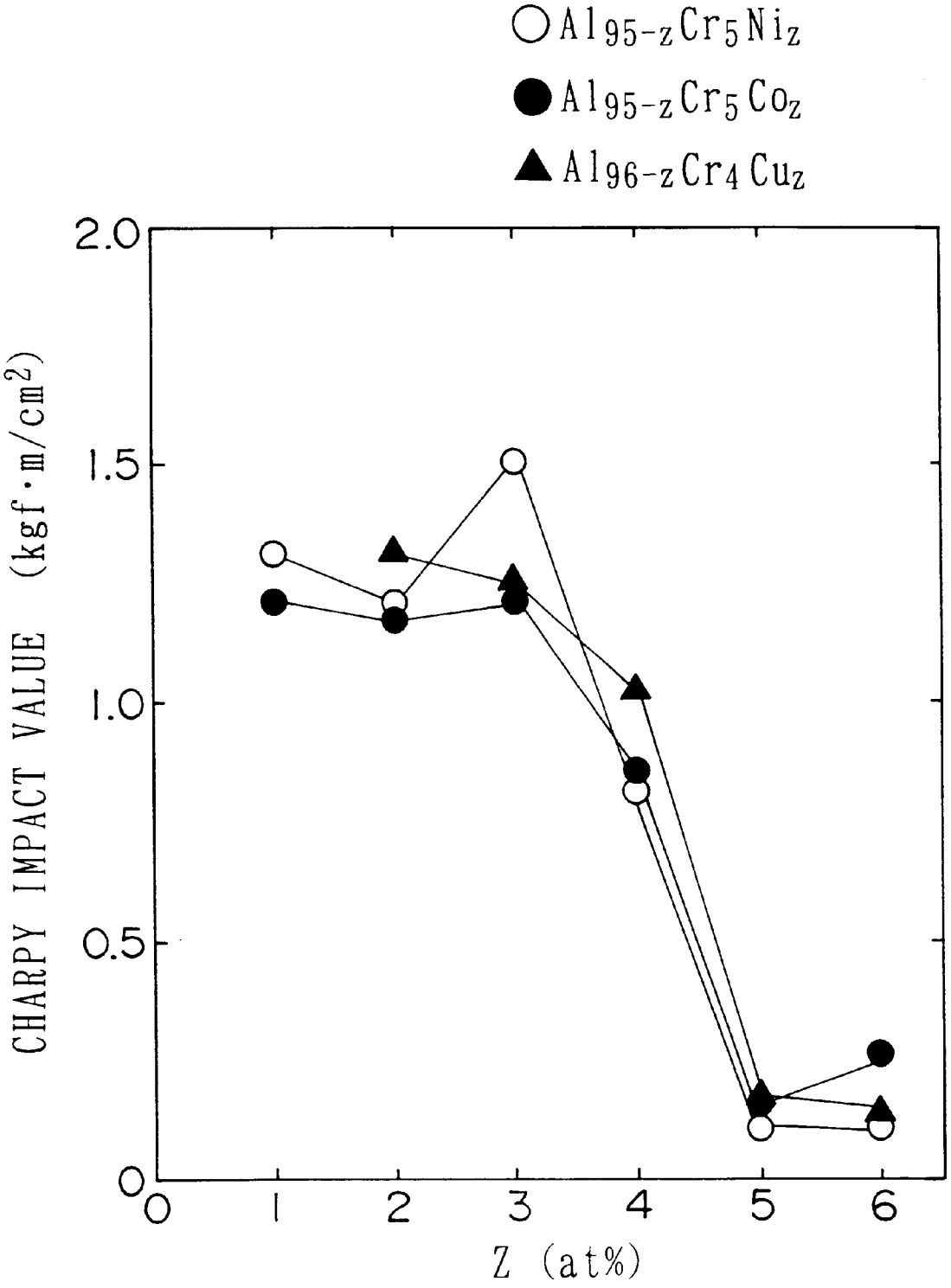
FIG. 7 is a graph showing the relationship between the atomic percentage of M (Ni, Co, or Cu) in the aluminum-based alloy $Al_xCr_yM_z$ and the Charpy impact value of the alloy.

According to the results in Table 4 and FIGS. 6 and 7, it was observed that an aluminum-based alloy having the atomic percentage of the metal element M (Ni, Co, or Cu) of 5% or higher possessed a low impact value and thus had a low toughness. Accordingly, it was concluded that the atomic percentage of the metal element M is preferably not more than 4%, and more preferably, not more than 3%.

TABLE 4

| Sample No. | Alloy composition (Subscript numerals represent atomic percentage) | Charpy impact value (kgf · m/cm$^2$) |
|---|---|---|
| 75 | $Al_{93}Mn_5Ni_2$ | 1.2 |
| 76 | $Al_{92}Mn_5Ni_3$ | 1.5 |
| 77 | $Al_{91}Mn_5Ni_4$ | 0.9 |
| 78 | $Al_{90}Mn_5Ni_5$ | 0.2 |
| 79 | $Al_{87}Mn_5Ni_8$ | 0.2 |
| 80 | $Al_{92}Mn_6Ni_2$ | 1.3 |
| 81 | $Al_{89}Mn_6Ni_5$ | 0.1 |
| 82 | $Al_{92}Mn_6Co_2$ | 1.5 |
| 83 | $Al_{90}Mn_6Co_4$ | 0.8 |
| 84 | $Al_{89}Mn_6Co_5$ | 0.2 |
| 85 | $Al_{87}Mn_6Co_7$ | 0.1 |
| 86 | $Al_{91}Mn_6Cu_3$ | 1.4 |
| 87 | $Al_{90}Mn_6Cu_4$ | 0.9 |
| 88 | $Al_{89}Mn_6Cu_5$ | 0.2 |
| 89 | $Al_{87}Mn_6Cu_7$ | 0.1 |
| 90 | $Al_{90}Mn_6Ni_2Co_2$ | 0.7 |
| 91 | $Al_{91}Mn_6Ni_1Cu_2$ | 1.2 |
| 92 | $Al_{90}Mn_6Co_2Cu_2$ | 0.7 |
| 93 | $Al_{89}Mn_6Ni_2Co_3$ | 0.1 |
| 94 | $Al_{93}Cr_5Ni_2$ | 1.2 |
| 95 | $Al_{92}Cr_5Ni_3$ | 1.5 |
| 96 | $Al_{91}Cr_5Ni_4$ | 0.8 |
| 97 | $Al_{90}Cr_5Ni_5$ | 0.1 |
| 98 | $Al_{87}Cr_5Ni_8$ | 0.2 |
| 99 | $Al_{92}Cr_6Ni_2$ | 1.3 |
| 100 | $Al_{89}Cr_6Ni_5$ | 0.1 |
| 101 | $Al_{92}Cr_6Co_2$ | 1.4 |
| 102 | $Al_{90}Cr_6Co_4$ | 0.8 |
| 103 | $Al_{89}Cr_6Co_5$ | 0.1 |
| 104 | $Al_{87}Cr_6Co_7$ | 0.1 |
| 105 | $Al_{91}Cr_6Cu_3$ | 1.2 |
| 106 | $Al_{90}Cr_6Cu_4$ | 0.9 |
| 107 | $Al_{89}Cr_6Cu_5$ | 0.1 |
| 108 | $Al_{87}Cr_6Cu_7$ | 0.3 |
| 109 | $Al_{90}Cr_6Ni_2Co_2$ | 0.6 |
| 110 | $Al_{91}Cr_6Ni_1Cu_2$ | 1.2 |
| 111 | $Al_{90}Cr_6Co_2Cu_2$ | 0.8 |
| 112 | $Al_{89}Cr_6Co_3Cu_2$ | 0.1 |

What is claimed is:

1. A production method for an aluminum-based alloy of high strength and high rigidity having a metallographic structure incorporating only a quasi-crystalline phase without any oxides, said production method comprising the step of: melting metals to prepare an alloy liquid-melt in a container; and performing quick-quench solidification of said alloy liquid-melt, by means of a liquid quick-quenching method, said alloy liquid-melt consisting of Al having an amount in atomic percentage of x, element L having an amount in atomic percentage of y, and element M having an amount in atomic percentage of z;

wherein said element L is a metal element selected from the group consisting of Mn and Cr; element M is at least one metal element selected from the group consisting of Ni, Co, and Cu, and x, y, and z satisfy the relationships $x+y+z=100$, $75 \leqq x \leqq 95$, $2 \leqq y \leqq 15$, and $0.5 \leqq z \leqq 4$.

2. A production method for an aluminum-based alloy of high strength and high rigidity having a metallographic structure incorporating only a quasi crystalline phase without any oxides, said production method comprising the steps of: melting metals to prepare an alloy liquid-melt in a container; and forming a thin layer of an aluminum-based alloy on a substrate by means of a layer formation process by using said alloy liquid-melt consisting of Al having an amount in atomic percentage of x, element L having an amount in atomic percentage of y, and element M having an amount in atomic percentage of z;

wherein said element L is a metal element selected from the group consisting of Mn and Cr; element M is at least one metal element selected from the group consisting of Ni, Co, and Cu; and x, y, and z satisfy the relationships $x+y+z=100$, $75 \leqq x \leqq 95$, $2 \leqq y \leqq 15$, and $0.5 \leqq z \leqq 4$.

3. A production method for an aluminum-based alloy of high strength and high rigidity having a metallographic structure incorporating only a quasi-crystalline phase without any oxides, said production method comprising the steps of: melting metals to prepare an alloy liquid-melt in a container; and quick-quenching said alloy liquid-melt by means of an atomizer method, to obtain a powder of an aluminum-based alloy, said alloy liquid-melt consisting of Al having an amount in atomic percentage of x, element L having an amount in atomic percentage of y, and element M having an amount in atomic percentage of z;

wherein said element L is a metal element selected from the group consisting of Mn and Cr; element M is at least one metal element selected from the group consisting of Ni, Co, and Cu; and x, y, and z satisfy the relationships $x+y+z=100$, $75 \leqq x \leqq 95$, $2 \leqq y \leqq 15$, and $0.5 \leqq z \leqq 4$.

4. A production method for an aluminum-based alloy of high strength and high rigidity having a metallographic structure incorporating only a quasi-crystalline phase without any oxides, said production method comprising the steps of: melting metals to prepare an alloy liquid-melt in a container; and quick-quenching said alloy liquid-melt by means of a spray method, to obtain a powder of an aluminum-based alloy, said alloy liquid-melt consisting of Al having an amount in atomic percentage of x, element L having an amount in atomic percentage of y, and element M having an amount in atomic percentage of z;

wherein said element L is a metal element selected from the group consisting of Mn and Cr; element M is at least one metal element selected from the group consisting of Ni, Co, and Cu; and x, y, and z satisfy the relationships $x+y+z=100$, $75 \leqq x \leqq 95$, $2 \leqq y \leqq 15$, and $0.5 \leqq z \leqq 4$.

5. A production method for an aluminum-based alloy of high strength and high rigidity having a metallographic structure incorporating a quasi-crystalline phase in accordance with claim 1, wherein up to one-half of the amount in atomic percentage of element M is substituted by one element selected from the group consisting of Ti and Zr.

6. A production method for an aluminum-based alloy of high strength and high rigidity having a metallographic structure incorporating a quasi-crystalline phase in accordance with claim 2, wherein up to one-half of the amount in atomic percentage of element M is substituted by one element selected from the group consisting of Ti and Zr.

7. A production method for an aluminum-based alloy of high strength and high rigidity having a metallographic structure incorporating a quasi-crystalline phase in accordance with claim 3, wherein up to one-half of the amount in atomic percentage of element M is substituted by one element selected from the group consisting of Ti and Zr.

8. A production method for an aluminum-based alloy of high strength and high rigidity having a metallographic structure incorporating a quasi-crystalline phase in accordance with claim 4, wherein up to one-half of the amount in atomic percentage of element M is substituted by one element selected from the group consisting of Ti and Zr.

9. An aluminum-based alloy of high strength and high rigidity made in accordance with the process of claim 1.

10. An aluminum-based alloy of high strength and high rigidity made in accordance with the process of claim 2.

11. An aluminum-based alloy of high strength and high rigidity made in accordance with the process of claim 3.

12. An aluminum-based alloy of high strength and high rigidity made in accordance with the process of claim 4.

13. An aluminum-based alloy of high strength and high rigidity according to claim 9, wherein up to one-half of the amount in atomic percentage of element M is substituted by one element selected from the group consisting of Ti and Zr.

14. An aluminum-based alloy of high strength and high rigidity according to claim 10, wherein up to one-half of the amount in atomic percentage of element M is substituted by one element selected from the group consisting of Ti and Zr.

15. An aluminum-based alloy of high strength and high rigidity according to claim 11, wherein up to one-half of the amount in atomic percentage of element M is substituted by one element selected from the group consisting of Ti and Zr.

16. An aluminum-based alloy of high strength and high rigidity according to claim 12, wherein up to one-half of the amount in atomic percentage of element M is substituted by one element selected from the group consisting of Ti and Zr.

* * * * *